US005760535A

United States Patent [19]

Moyer et al.

[11] Patent Number: 5,760,535

[45] Date of Patent: Jun. 2, 1998

[54] FIELD EMISSION DEVICE

[75] Inventors: Curtis D. Moyer, Phoenix; John Song, Tempe; James E. Jaskie; Lawrence N. Dworsky, both of Scottsdale; Scott K. Ageno, Phoenix; Robert P. Nee, Gilbert, all of Ariz.

[73] Assignee: Motorola, Inc., Schaumburg, Ill.

[21] Appl. No.: 740,583

[22] Filed: Oct. 31, 1996

[51] Int. Cl.[6] ..... H01J 1/02

[52] U.S. Cl. ..... 313/309; 313/310; 313/351; 313/497

[58] Field of Search ..... 313/309, 310, 313/336, 351, 495, 496, 497

[56] References Cited

U.S. PATENT DOCUMENTS 5,235,244 8/1993 Spindt ..... 313/309

5,396,150 3/1995 Wu et al. ..... 313/309

5,606,215 2/1997 Jaskie et al. ..... 313/309

*Primary Examiner*—George M. Dombroske

*Assistant Examiner*—Harshad Patel

*Attorney, Agent, or Firm*—Kathleen Anne Tobin; Eugene A. Parsons

[57] ABSTRACT

A field emission device (200, 300, 400, 500) includes a supporting substrate (210, 310, 410, 510), a cathode (215, 315, 415, 515) formed thereon, a plurality of electron emitters (270, 370, 470, 570) and a plurality of gate extraction electrodes (250, 350, 450, 550) proximately disposed to the plurality of electron emitters (270, 370, 470, 570) for effecting electron emission therefrom, a major dielectric surface (248, 348, 448, 548) disposed between the plurality of gate extraction electrodes (250, 350, 450, 550), a charge dissipation layer (252, 352, 452, 552) formed on the major dielectric surface (248, 348, 448, 548), and an anode (280, 380, 480, 580) spaced from the gate extraction electrodes (250, 350, 450, 550).

19 Claims, 3 Drawing Sheets

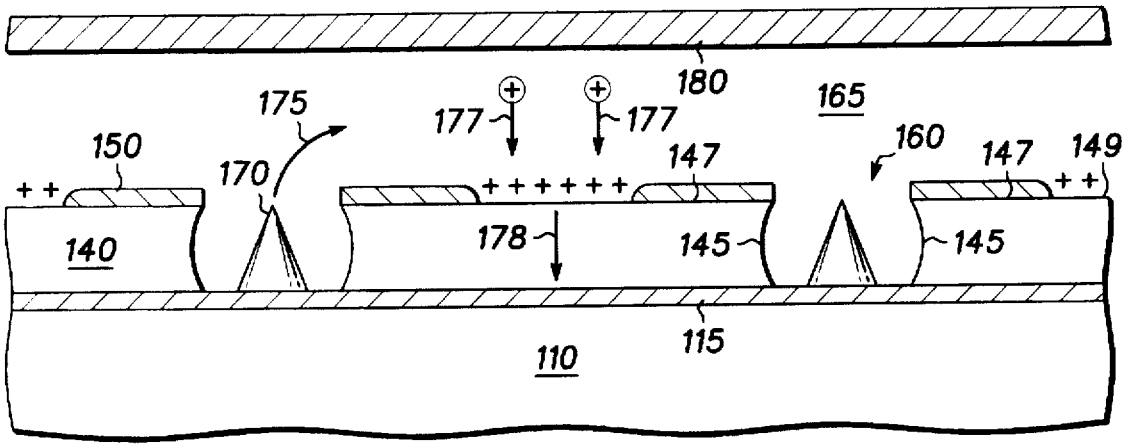
FIG. 1 100 - PRIOR ART -
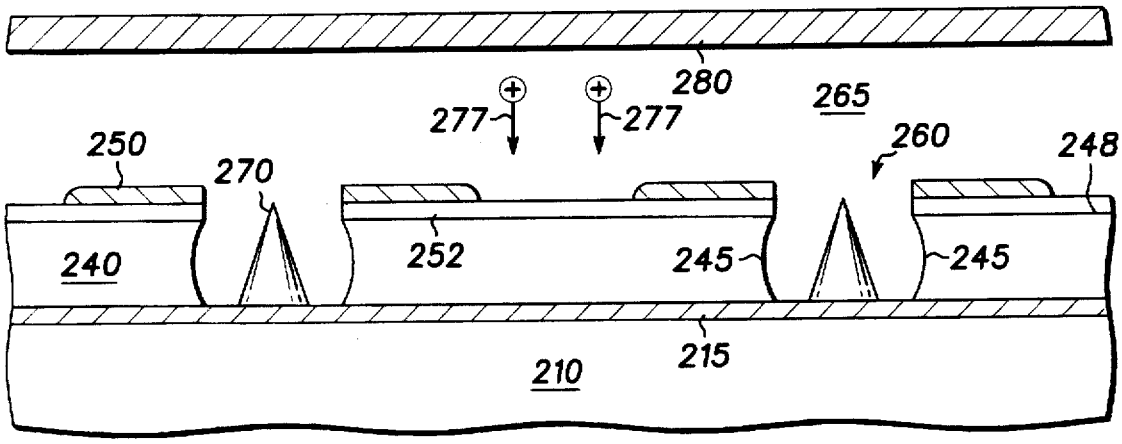
FIG. 2 200
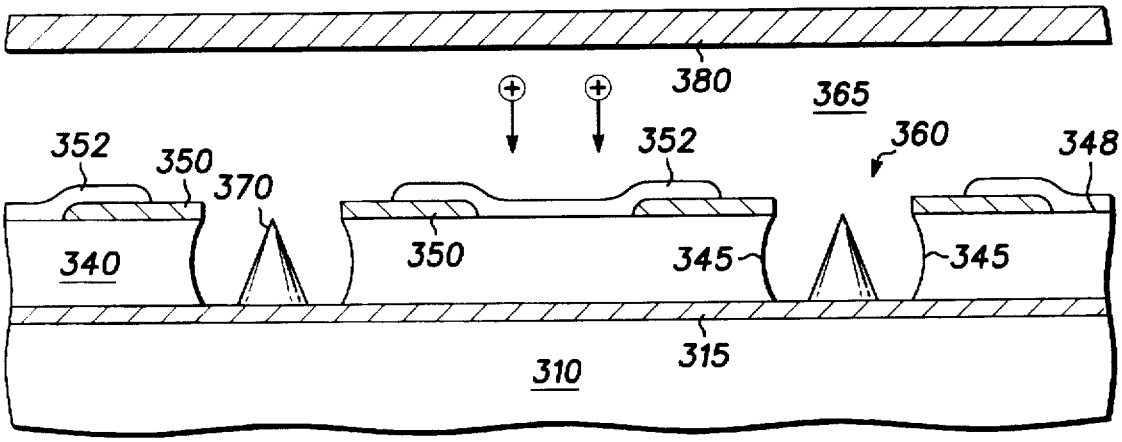
FIG. 3 300

FIELD EMISSION DEVICE

Field of the Invention

The present invention pertains to the field of field emission devices and, more particularly, to the field of field emission devices having major exposed dielectric surfaces therein.

BACKGROUND OF THE INVENTION

Field emission devices, and addressable matrices of field emission devices, are known in the art. Selectively addressable matrices of field emission devices are used in, for example, field emission displays. Illustrated in FIG. 1 is a prior art field emission device (FED) 100 having a triode configuration. FED 100 includes a plurality of gate extraction electrodes 150 which are spaced from a cathode 115 by a dielectric layer 140. Cathode 115 includes a layer of a conductive material, such as molybdenum, which is deposited on a supporting substrate 110. Dielectric layer 140, made from a dielectric material such as silicon dioxide, electrically isolates gate extraction electrodes 150 from cathode 115. Spaced from gate electrodes 150 is an anode 180, which is made from a conductive material, thereby defining an interspace region 165. Interspace region 165 is typically evacuated to a pressure below $10^{-6}$ Torr. Dielectric layer 140 has vertical surfaces 145 which define emitter wells 160. A plurality of electron emitters 170 are disposed, one each, within emitter wells 160 and may include Spindt tips. Dielectric layer 140 also includes a major surface having covered portions 147 and exposed portions 149. Gate extraction electrodes 150 are disposed on covered portions 147. Exposed portions 149 of the major surface of dielectric layer 140 are exposed to interspace region 165. During the operation of FED 100, and as is typical of triode operation in general, suitable voltages are applied to gate extraction electrodes 150, cathode 115, and anode 180 for selectively extracting electrons from electron emitters 170 and causing them to be directed toward anode 180. A typical voltage configuration includes an anode voltage within the range of 100–10,000 volts; a gate extraction electrode voltage within a range of 10–100 volts; and a cathode potential below about 10 volts, typically at electrical ground. Emitted electrons strike anode 180, liberating gaseous species therefrom. Along their trajectories from electron emitters 170 to anode 180, emitted electrons also strike gaseous species, some of which originate from anode 180, present in interspace region 165. In this manner, cationic species are created within interspace region 165, as indicated by encircled "+" symbols in FIG. 1. When FED 100 is incorporated into in a field emission display, anode 180 has deposited thereon a cathodoluminescent material which, upon receipt of electrons, is caused to emit light.

Upon excitation, common cathodoluminescent materials tend to liberate substantial amounts of gaseous species, which are also vulnerable to bombardment by electrons to form cations. Cationic species within interspace region 165 are repelled from the high positive potential of anode 180, as indicated by a pair of arrows 177 in FIG. 1, and are caused to strike gate extraction electrodes 150 and exposed portions 149 of the major surface of dielectric layer 140. Those striking gate extraction electrodes 150 are bled off as gate current; those striking exposed portions 149 of the major surface of dielectric layer 140 are retained therein, resulting in a build up of positive potential, as indicated by "+" symbols in FIG. 1. This build up of positive potential at exposed portions 149 continues until either dielectric layer 140 breaks down due to the realization thereover of the breakdown potential of the dielectric material, which is typically in the range of 300–500 volts, or until the positive potential is high enough to deflect (indicated by an arrow 175 in FIG. 1) electrons toward the major surface of dielectric layer 140, causing them to be received by exposed portions 149, and thereby neutralizing the surface charge. In the latter instance, the charge buildup/neutralization cycle is subsequently repeated and the control of gate extraction electrodes 150 is lost; in the former instance, the breakdown of dielectric layer 140 often results in initiation of an arc from anode 180 and catastrophic current (indicated by an arrow 178 in FIG. 1) between cathode 115 and exposed portions 149, destroying dielectric layer 140 and cathode 115 and thereby rendering FED 100 inoperable.

In the development of field emission devices it has become desirable to minimize the amount of area overlap between gate extraction electrodes 150 and cathode 115 in order to lower power requirements due to inter-electrode capacitances. Reduction in area of gate extraction electrodes 150 has simultaneously increased the area of exposed portions 149 of the major surface of dielectric layer 140. This has resulted in exacerbation of dielectric charging problems and the concomitant loss of control or failure of the devices, as described in detail above.

Prior art electron tubes, such as cathode ray tubes used in televisions, have solved arcing problems due to charging of dielectric surfaces by coating otherwise exposed dielectric surfaces with a thin film of a conductive material, such as tin oxide. This technique is ineffective for solving the analogous charging problem in FED 100 because coating exposed portions 149 of dielectric layer 140 with a material such as tin oxide would cause shorting between gate extraction electrodes 150, effectively ruining the addressibility of electron emitters 170. This addressibility is crucial for the use of FED 100 in applications such as field emission displays.

Thus, there exists a need for a field emission device having low area of overlap between the gate extraction electrode and the cathode which does not fail from the accumulation of positive charge at the major exposed dielectric surfaces within the device.

BRIEF DESCRIPTION OF THE DRAWINGS

Referring to the drawings:

FIG. 1 is a cross-sectional view of a prior art field emission device;

FIG. 2 is a cross-sectional view of an embodiment of a field emission device in accordance with the present invention;

FIG. 3 is a cross-sectional view of another embodiment of a field emission device in accordance with the present invention;

DESCRIPTION OF THE PREFERRED EMBODIMENT

Figure 4:
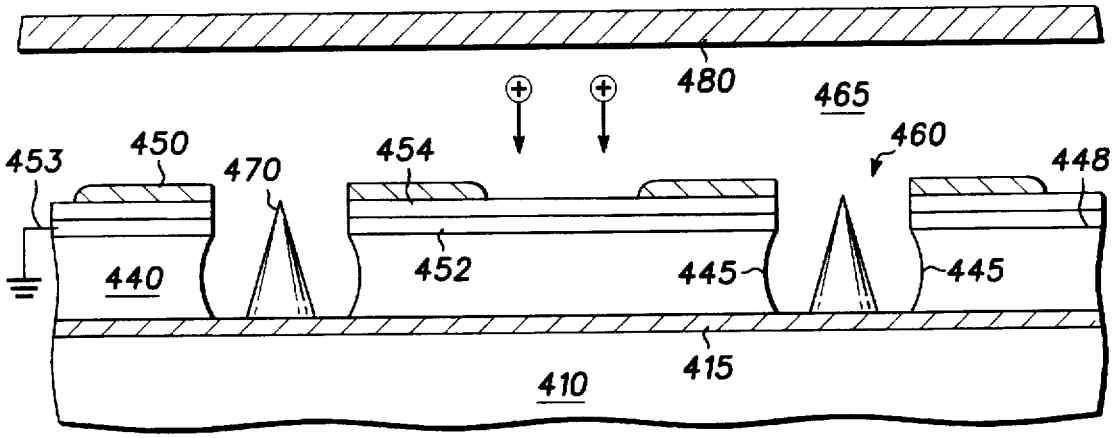
FIG. 4 is a cross-sectional view of another embodiment of a field emission device in accordance with the present invention.

Referring now to FIG. 2, there is depicted a cross-sectional view of a field emission device (FED) 200 in accordance with the present invention. FED 200 includes a supporting substrate 210, which may be made from glass, such as borosilicate glass, or silicon. Upon supporting substrate 210, is formed a cathode 215. In this particular embodiment, cathode 215 includes a layer of conductive material, such as molybdenum. FED 200 further includes a dielectric layer 240 is formed on cathode 215. Dielectric layer 240 has a plurality of vertical surfaces 245 which define a plurality of emitter wells 260. An electron emitter 270 is disposed on cathode 215 within each of emitter wells 260. In this particular embodiment, electron emitter 270 includes a Spindt tip. In another embodiment, cathode 215 may include a layer having a ballast resistor portion, made from, for example, amorphous silicon, which underlies electron emitter 270, and a conductive portion which is made from a conductive material, such as aluminum or molybdenum, being in ohmic contact with the ballast resistor portion. Dielectric layer 240 further includes a major dielectric surface 248. In accordance with the present invention, a charge dissipation layer 252 is formed on major dielectric surface 248. Charge dissipation layer 252 is made from a material having a sheet resistance within a range of $10^9$–$10^{12}$ Ohms/square. It is preferably made of undoped amorphous silicon; however, any material within the above range of sheet resistances and having suitable film characteristics may be employed. Suitable film characteristics include adequate adhesion to major dielectric surface 248 and resistance toward subsequent processing steps. A plurality of gate extraction electrodes 250 are deposited and patterned on dielectric layer 240 and are spaced from electron emitters 270. A ballast resistor portion may be included in cathode 215 to help prevent destructive arcing between electron emitters 270 and gate extraction electrodes 250. FED 200 further includes an anode 280, which is spaced from gate extraction electrodes 250, to define an interspace region 265 therebetween, and includes a conductive material for receiving electrons. The electrical sheet resistance provided by charge dissipation layer 252 is predetermined to effect the conduction of positively charged species which impinge upon it, thereby preventing the accumulation of positive surface charge during the operation of FED 200. The ionic current produced within interspace region 265, as a percentage of emitted electrons, is believed to be less than or equal to about 0.1%. In a field emission display, for example, the cationic return current is believed to be about 10 picoamps. Because the cationic current is so small, the sheet resistance of charge dissipation layer 252 can be made high enough to prevent shorting, and excessive power loss, between gate extraction electrodes 250 while still adequate to conduct/bleed-off impinging charges. The operation of FED 200 includes applying the appropriate potentials, via grounded voltage sources (not shown) which are external to FED 200, to cathode 215, gate extraction electrodes 250, and anode 280 to produce electron emission from electron emitters 270 and to guide the emitted electrons toward anode 280 at an appropriate acceleration. In this particular embodiment, the returning cationic current, as indicated by an arrow 277 in FIG. 2, is bled into gate extraction electrodes 250 because electrical contact is made by forming gate extraction electrodes 250 on top of charge dissipation layer 252. The fabrication of FED 200 includes standard methods of forming a Spindt tip field emission device and further includes adding a deposition step wherein a layer of the material comprising charge dissipation layer, such as undoped amorphous silicon, is deposited upon the dielectric layer which is formed on cathode 215. The charge dissipation material layer may be deposited by sputtering or plasma-enhanced chemical vapor deposition (PECVD) to a thickness within a range of 100–5000 angstroms. Thereafter, gate extraction electrodes 250 are formed from a conductor, such as molybdenum, and patterned on the charge dissipation material layer. Then, emitter wells 260 are formed by selectively etching through the layer of charge dissipation material and the dielectric layer. Electron emitters 270 are formed in emitter wells 260 by standard tip fabrication techniques, known to one skilled in the art. Standard deposition and patterning techniques may be employed.

Referring now to FIG. 3, there is depicted a cross-sectional view of a field emission device (FED) 300, in accordance with the present invention. FED 300 includes elements of FED 200 (FIG. 2), which are similarly referenced, beginning with a "3". In this particular embodiment, a charge dissipation layer 352 is deposited subsequent the formation of a plurality of gate extraction electrodes 350 and covers a portion of gate extraction electrodes 350, thereby providing electrical contact therewith. Charge dissipation layer 352 may be deposited by evaporation subsequent the etching of a plurality of emitter wells 360. This reduces the number of processing steps to which charge dissipation layer 352 is exposed subsequent its formation. Charge dissipation layer 352 may be patterned utilizing a mask distinct from that used to form emitters wells 360. In another embodiment, the edge of the charge dissipation layer is aligned with an edge of the gate extraction electrode; for example, when the charge dissipation layer is etched in the same mask sequence as that forming the emitters wells, their well-side edges are aligned. This eliminates a mask step. The operation of FED 300 is the same as that of FED 200 described with reference to FIG. 2. Charge dissipation layer 352 precludes the impingement of gaseous cations onto a major dielectric surface 348 of a dielectric layer 340, thereby preventing the formation of a charged dielectric surface which would otherwise deflect electrons or result in dielectric breakdown.

Referring now to FIG. 4, there is depicted a cross-sectional view of a field emission device (FED) 400, in accordance with the present invention. FED 400 includes elements of FED 200 (FIG. 2), which are similarly referenced, beginning with a "4". FED 400 further includes a leaky dielectric layer 454, in accordance with the present invention. Leaky dielectric layer 454 is disposed on a charge dissipation layer 452 of FED 400. In this particular embodiment charge dissipation layer 452 covers a major dielectric surface 448 of a dielectric layer 440. FED 400 is fabricated in a manner similar to that of FED 200 described with reference to FIG. 2 and further includes a step of depositing a layer of a leaky dielectric on the charge dissipation material layer. Leaky dielectric layer 454 has properties which allow it to conduct current toward charge dissipation layer 452 beneath it. Suitable materials for leaky dielectric layer 454 include silicon nitride and silicon oxynitride, and any other dielectric material which is sufficiently leaky to allow for conduction of current through to the buried charge dissipation layer 452. Leaky dielectric layer 454 has a thickness within a range of about 500–2000 angstroms; charge dissipation layer 452 has a thickness within a range of about 100–5000 angstroms. Conduction of charge vertically downward through leaky dielectric layer 454 is due to the small ratio of the length of the current path to the cross-sectional area of the current path. In this particular embodiment, charge dissipation layer 452 is not in ohmic contact with a plurality of gate extraction electrodes 450 of FED 400. Leaky dielectric layer 454 allows impinging charge to pass through it vertically, lateral conduction therein being negligible. This provides the benefit of very low power losses between gate extraction electrodes 450. To bleed the charge out of FED 400, charge dissipation layer 452 is independently connected to a grounded electrical contact 453 external FED 400, as illustrated in FIG. 4, thereby providing an independent conduction path for the surface charge. It is believed that the conduction path of the surface charge may include a vertical rise through leaky dielectric layer 454 between charge dissipation layer 452 and gate extraction electrodes 450: positive charge is received by leaky dielectric layer 454, conducted vertically downward to be received by charge dissipation layer 452, then conducted laterally through charge dissipation layer 452 to a portion thereof beneath gate extraction electrodes 450, and then conducted vertically upward through leaky dielectric layer 454 to gate extraction electrodes 450. In this manner, electrical contact between charge dissipation layer 452 and gate extraction electrodes 450 is established by providing leaky dieletric layer 454 therebetween. This conduction path into gate extraction electrodes 450 may be sufficient so that grounded electrical contact 453 may be omitted. Because charge dissipation layer 452 does not provide ohmic contact between gate extraction electrodes 450, its sheet resistance may be made lower than that of the embodiments described with reference to FIGS. 2 and 3. Thus, a wider range of materials may be employed to form charge dissipation layer 452, such as amorphous silicon, tin oxide, copper oxide, and conductive ceramics. A material can thereby be selected for its film properties, such as adhesion, stress, and process compatibility. However, it is desirable to maintain a high resistance to limit the capacitive charging of charge dissipation layer 452, thereby limiting the additional capacitive charging power associated with adding charge dissipation layer 452.

A field emission device in accordance with the present invention may include electron emitters other than Spindt tips. Other electron emitters include, but are not limited to, edge emitters and surface/film emitters. Edge and surface emitters may be made from field emissive materials, such as carbon-based films including diamond-like carbon, non-crystalline diamond-like carbon, diamond, and aluminum nitride. All dielectric surfaces within these field emission devices, which are not otherwise covered by active elements of the device, may be covered by a charge dissipation layer, in accordance with the present invention, to preclude the formation of positively charged dielectric surfaces. Similarly, a field emission device in accordance with the present invention may include electrode configurations other than a triode, such as diode and tetrode. A charge dissipation layer in accordance with the present invention may also be formed on a dielectric surface adjacent the outermost electron emitters in an array of electron emitters; these peripheral dielectric surfaces may not include portions of the device electrodes, but they nevertheless are susceptible to surface charging which distorts the trajectories of electrons emitted by field emitters adjacent to them. To conduct away the charge, the charge dissipation layer on the peripheral dielectric surface extends to a gate electrode or to a grounded electrical contact external the field emission device.

Figure 5:
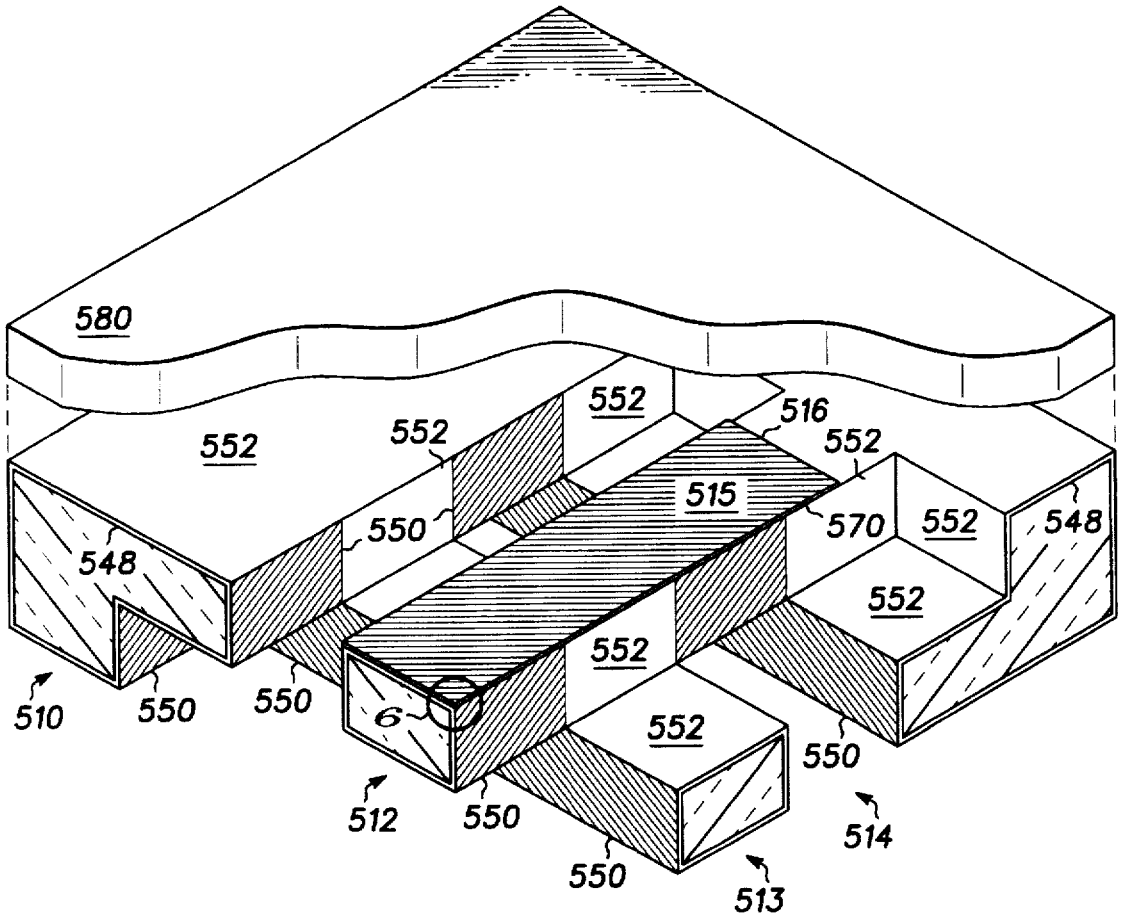
FIG. 5 is a partial perspective view of an embodiment of a field emission device, in accordance with the present invention.

Referring now to FIG. 5, there is depicted a partial perspective view of a field emission device (FED) 500, in accordance with the present invention. FED 500 includes a supporting substrate 510 which includes a plate of glass into which a first plurality of elongated parallel grooves has been formed (by, for example, using a diamond saw) in one face thereof, and a second plurality of elongated parallel grooves has been formed in the opposing face thereof, generally perpendicularly to the first plurality of elongated parallel grooves. First and second elongated parallel grooves define a plurality of apertures 514. In this manner, a first plurality of elongated members 512 is formed in the first face, and a second plurality of elongated members 513 is formed in the opposing face of the plate. The facing surfaces of adjacent, parallel elongated members 512 are selectively patterned, by using standard directional deposition techniques, with molybdenum or other suitable metal to form a plurality of gate extraction electrodes 550. An edge electron emitter 570 is formed on the upper surfaces of elongated members 512. Upon each edge electron emitter 570 is deposited a cathode 515, which includes a layer of molybdenum or other suitable conductor. In a manner similar to that described with reference to FIG. 2, suitable potentials are applied to cathodes 515 and gate extraction electrodes 550 to selectively address edge electron emitters 570. Electrons are emitted from the addressed portions of edge electron emitters 570, and are attracted toward an anode 580, which is operably coupled to a voltage source for applying a positive potential thereto in the range of 100–10,000 volts. In accordance with the present invention, a charge dissipation layer 552 is deposited, as a blanket coating, onto all major dielectric surfaces 548 of supporting substrate 510, prior to the deposition of the active elements of FED 500. Major dielectric surfaces 548 include the exposed dielectric surfaces between active elements of FED 500, at its central portion, and the dielectric surfaces at the periphery of FED 500, adjacent the outermost of edge electron emitters 570. Charge dissipation layer 552 may include undoped amorphous silicon or other resistive material having a sheet resistance in the range of $10^9$–1012 Ohms/square. Subsequent the blanket coating of supporting substrate 510 with the charge dissipation material, gate extraction electrodes 550 are deposited, followed by the formation of edge electron emitters 570, and, thereafter, the deposition of cathodes 515. In another embodiment of the present device, and in a manner analogous to the structure described with reference to FIG. 4, a leaky dielectric layer may further be included in FED 500, the leaky dielectric layer being deposited, as a blanket coating, on charge dissipation layer 552, prior to the deposition of the other, active elements of the device. A more detailed description of the fabrication of supporting substrate 510, and of all the active elements of FED 500, is disclosed in co-pending U.S. patent application entitled "Edge Electron Emitters for an Array of FEDS", Ser. No. 08/489,017, filed on Jun. 08, 1995, assigned to the same assignee, and which is incorporated herein by reference. In this particular embodiment, charge dissipation layer 552 is connected to a grounded electrical contact (not shown) external FED 500 by providing electrical contact between charge dissipation layer 552 and gate extraction electrodes 550. The charge may also be bled by providing electrical contact between charge dissipation layer 552 and cathodes 515. This may be achieved, for example, by extending the coverage of cathodes 515 beyond edge electron emitters 570 at predetermined portions thereof and operably connecting cathodes 515 to charge dissipation layer 552. For example, an end 516 of each of cathodes 515 may be extended beyond edge electron emitters 570 and form an electrical contact with a portion of charge dissipation layer 552 at the periphery of FED 500. If a leaky dielectric layer is additionally disposed upon charge dissipation layer 552, charge dissipation layer 552 may be independently connected to a grounded electrical contact in a manner similar to that described with reference to FIG. 4, thereby providing an independent conduction path for the surface charge.

Figure 6:
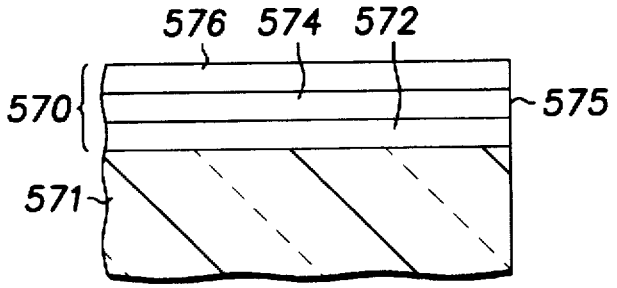
FIG. 6 is a greatly enlarged partial view of a field emitter of the field emission device of FIG. 5.

Referring now to FIG. 6, there is depicted a greatly enlarged partial view of edge electron emitter 570 of FED 500 (FIG. 5). Edge electron emitter 570 includes a ballasting layer 572, an electron emitting layer 574, and a field shaper layer 576. First, a dielectric spacer layer 571 is deposited on charge dissipation layer 552 at the upper surfaces of elongated members 512. Dielectric spacer layer 571 is made from a dielectric material such as silicon dioxide, which may be deposited by PECVD. Dielectric spacer layer 571 sets the distance between gate extraction electrodes 550 and cathodes 515, and prevents shorting therebetween. Next, ballasting layer 572 is deposited on dielectric spacer layer 571 and is made from doped amorphous silicon. Then, electron emitting layer 574 is formed on ballasting layer 572 and defines an electron emitting edge 575. Electron emitting layer 574 is made from an electron emissive material, such as diamond-like carbon, non-crystalline diamond-like carbon, diamond, aluminum nitride, and any other material exhibiting a work function of less than approximately 1 electron volt. Thereafter, field shaper layer 576 is deposited on electron emitting layer 574 and includes a boron-doped or undoped amorphous silicon. Field shaper layer 576 functions to shape the electric field in the region of electron emitting edge 575.

Figure 7:
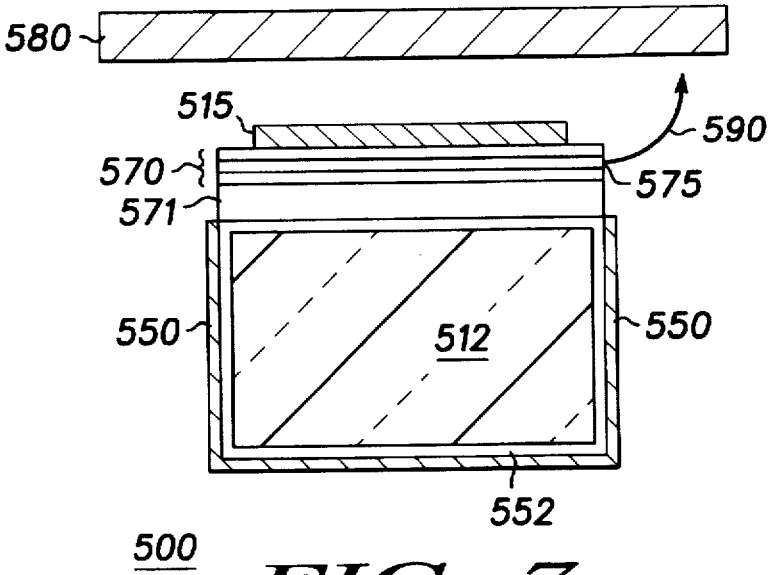
FIG. 7 is a side elevational partial view of the field emission device of FIG. 5.

Referring now to FIG. 7, there is depicted a side elevational partial view of FED 500 of as depicted in FIG. 5 and further illustrates the emission of electrons within FED 500. Shown in FIG. 7 is one of elongated members 512 and the opposing portion of anode 580. Upon the application of appropriate voltages at gate extraction electrodes 550 and cathodes 515, an electric field is created in the region of edge electron emitter 570. Electrons are thereby extracted from electron emitting edge 575 of edge electron emitter 570. The electrons are attracted toward anode 580 by a positive voltage applied thereto, as indicated by an arrow 590 in FIG. 7. Those portions of charge dissipation layer 552 that are not shielded by gate extraction electrodes 550 and cathodes 515, conduct charges impinging thereon toward gate extraction electrodes 550, thereby preventing accumulation of surface charge which would otherwise deflect emitted electrons from their predetermined trajectory or cause uncontrolled emission.

While we have shown and described specific embodiments of the present invention, further modifications and improvements will occur to those skilled in the art. We desire it to be understood, therefore, that this invention is not limited to the particular forms shown, and we intend in the appended claims to cover all modifications that do not depart from the spirit and scope of this invention.

We claim:

1. A field emission device comprising:

a supporting substrate;

a plurality of active elements including a plurality of electron emitters and a plurality of electrodes proximate the plurality of electron emitters for effecting emission of electrons therefrom, the plurality of active elements being supported by the supporting substrate;

a major dielectric surface which would otherwise be susceptible to electrical charging during operation of the field emission device, the major dielectric surface being proximately disposed with respect to a portion of the plurality of electron emitters;

a charge dissipation layer disposed on the major dielectric surface and being operably coupled to a grounded electrical contact external the field emission device; and an anode being spaced from the supporting substrate and being disposed to receive electrons emitted from the plurality of electron emitters whereby the charge dissipation layer prevents electrical charging of the major dielectric surface.

2. A field emission device as claimed in claim 1 wherein the charge dissipation layer is made from amorphous silicon.

3. A field emission device as claimed in claim 1 wherein the charge dissipation layer has a sheet resistance within a range of $10^9$–$10^{12}$ Ohms/square.

4. A field emission device as claimed in claim 1 further including a leaky dielectric layer disposed on the charge dissipation layer.

5. A field emission device as claimed in claim 4 wherein the leaky dielectric layer is made from silicon nitride.

6. A field emission device as claimed in claim 4 wherein the leaky dielectric layer is made from silicon oxynitride.

7. A field emission device comprising:

a supporting substrate;

a cathode formed on a first portion of the supporting substrate;

a plurality of electron emitters proximately disposed with respect to the cathode;

a plurality of gate extraction electrodes operably disposed with respect to the cathode for effecting electron emission from the plurality of electron emitters;

a major dielectric surface disposed between the plurality of gate extraction electrodes;

a charge dissipation layer formed on the major dielectric surface and being operably coupled to a grounded electrical contact external the field emission device; and an anode spaced from the supporting substrate and disposed to receive electrons emitted by the plurality of electron emitters.

8. A field emission device as claimed in claim 7 wherein the charge dissipation layer is made from amorphous silicon.

9. A field emission device as claimed in claim 7 wherein the charge dissipation layer has a sheet resistance within a range of $10^9$–$10^{12}$ Ohms/square.

10. A field emission device as claimed in claim 7 further including a leaky dielectric layer disposed on the charge dissipation layer.

11. A field emission device as claimed in claim 10 wherein the leaky dielectric layer is made from silicon nitride.

12. A field emission device as claimed in claim 10 wherein the leaky dielectric layer is made from silicon oxynitride.

13. A method for preventing positive charging of an exposed dielectric surface within a field emission device including the steps of providing a charge dissipation layer on the exposed dielectric surface and operably coupling the charge dissipation layer to a grounded electrical contact external the field emission device.

14. A method for preventing positive charging of an exposed dielectric surface as claimed in claim 13, wherein the charge dissipation layer is made from amorphous silicon.

15. A method as claimed in claim 13 wherein the step of operably coupling the charge dissipation layer to a grounded electrical contact external the field emission device includes providing electrical contact between the charge dissipation layer and a gate extraction electrode of the field emission device.

16. A method as claimed in claim 15 wherein the step of providing electrical contact between the charge dissipation layer and the gate extraction electrode of the field emission device includes providing a leaky dieletric layer therebetween.

17. A method as claimed in claim 13 wherein the step of operably coupling the charge dissipation layer to a grounded electrical contact external the field emission device includes providing a grounded electrical contact external to the field emission device and connecting the charge dissipation layer to the grounded electrical contact.

18. A method as claimed in claim 13 wherein the step of operably coupling the charge dissipation layer to a grounded electrical contact external the field emission device includes providing electrical contact between the charge dissipation layer and a cathode of the field emission device.

19. A method as claimed in claim 18 wherein the step of providing electrical contact between the charge dissipation layer and the cathode of the field emission device includes providing a leaky dieletric layer therebetween.

* * * * *